US010533330B2

(12) United States Patent
Rosati

(10) Patent No.: US 10,533,330 B2
(45) **Date of Patent: *Jan. 14, 2020**

(54) CONCRETE FORMWORK AND A FORMWORK SUPPORT BRACKET FOR FORMING A SUSPENDED FLOOR SLAB

(71) Applicant: Form 700 Pty Ltd, Altona (AU)

(72) Inventor: Emilio Rosati, Altona (AU)

(73) Assignee: Form 700 Pty Ltd, Altona (AU)

( * ) Notice: Subject to any disclaimer, the term of this patent is extended or adjusted under 35 U.S.C. 154(b) by 0 days.

This patent is subject to a terminal disclaimer.

(21) Appl. No.: 16/056,218

(22) Filed: Aug. 6, 2018

(65) Prior Publication Data

US 2018/0347212 A1 Dec. 6, 2018

Related U.S. Application Data

(63) Continuation of application No. 15/504,782, filed as application No. PCT/AU2015/000495 on Aug. 19, 2015, now Pat. No. 10,260,244.

(51) Int. Cl.

| | |
|---|---|
| ***E04G 11/36*** | (2006.01) |
| ***E04G 11/48*** | (2006.01) |
| ***E04G 11/38*** | (2006.01) |
| ***E04G 13/06*** | (2006.01) |

(52) U.S. Cl.

CPC ..... *E04G 11/365* (2013.01); *E04G 11/36* (2013.01); *E04G 11/38* (2013.01); *E04G 11/48* (2013.01); *E04G 13/06* (2013.01); *E04G 13/062* (2013.01)

(58) Field of Classification Search

CPC ..... E04G 11/36; E04G 11/38; E04G 11/48; E04G 11/483; E04G 11/486; E04G 13/06; E04G 13/066; E04G 11/365

USPC ..... 52/298, 299, 714; 108/150

See application file for complete search history.

(56) References Cited

U.S. PATENT DOCUMENTS

| | | | | |
|---|---|---|---|---|
| 1,498,665 A | | 6/1924 | MacIvor | |
| 1,612,516 A | | 12/1926 | Lampert | |
| 2,286,167 A | * | 6/1942 | Davis | E04B 5/29 52/334 |
| 2,331,247 A | | 10/1943 | Symons | |
| 3,203,660 A | | 8/1965 | Bowden | |
| 3,239,188 A | | 3/1966 | Gostling | |
| 3,861,634 A | * | 1/1975 | Hood | E01D 21/00 248/228.3 |
| 3,915,423 A | | 10/1975 | Tooley | |

(Continued)

FOREIGN PATENT DOCUMENTS

| | | |
|---|---|---|
| DE | 26 48 281 A1 | 4/1978 |
| EP | 0 380 149 A1 | 8/1990 |

(Continued)

OTHER PUBLICATIONS

International Search Report and Written Opinion dated Nov. 9, 2015, issued in corresponding Application No. PCT/AU2015/000495, filed Aug. 19, 2015, 12 pages.

*Primary Examiner* — Michael Safavi

(74) *Attorney, Agent, or Firm* — Christensen O'Connor Johnson Kindness PLLC

(57) ABSTRACT

The present invention relates to a formwork arrangement for forming a suspended concrete floor slab comprising a change in level in an underside thereof, a support bracket for use with such a formwork arrangement, and a method for employing the support bracket and formwork arrangement.

4 Claims, 3 Drawing Sheets

(56) References Cited

U.S. PATENT DOCUMENTS

| | | | | | |
|---|---|---|---|---|---|
| 3,945,167 | A | * | 3/1976 | Wendt | E04B 2/62 52/714 |
| 4,486,000 | A | | 12/1984 | Klaiss | |
| 4,492,358 | A | | 1/1985 | Manderla | |
| 4,741,505 | A | | 5/1988 | Anderson | |
| 4,787,183 | A | | 11/1988 | Johnston | |
| 4,899,497 | A | * | 2/1990 | Madl, Jr. | E04B 1/0007 52/126.6 |
| 4,910,934 | A | * | 3/1990 | Hennings | E04B 1/2608 52/210 |
| 5,096,155 | A | | 3/1992 | Fitzgerald | |
| 5,560,171 | A | * | 10/1996 | McCoy | E02D 27/02 52/297 |
| 5,946,867 | A | * | 9/1999 | Snider, Jr. | E04F 15/02458 52/126.6 |
| 6,832,746 | B2 | * | 12/2004 | McCracken | E04G 11/483 248/357 |
| 2003/0033758 | A1 | | 2/2003 | Sanger | |
| 2004/0075042 | A1 | | 4/2004 | Arozena Bergaretxe | |
| 2009/0250589 | A1 | | 10/2009 | Schwörer | |
| 2009/0266950 | A1 | | 10/2009 | Spera | |
| 2012/0042600 | A1 | | 2/2012 | Bacon | |
| 2014/0035181 | A1 | * | 2/2014 | Pantano | E04G 13/062 264/35 |
| 2014/0223853 | A1 | | 8/2014 | Rosati | |
| 2014/0263941 | A1 | | 9/2014 | Zhang | |
| 2017/0275902 | A1 | | 9/2017 | Faresin | |

FOREIGN PATENT DOCUMENTS

| | | | |
|---|---|---|---|
| GB | 2 297 786 | A | 8/1996 |
| WO | 2013/153478 | A1 | 10/2013 |

* cited by examiner

Section A-A

Section B-B

Plan View

CONCRETE FORMWORK AND A FORMWORK SUPPORT BRACKET FOR FORMING A SUSPENDED FLOOR SLAB

PRIORITY DOCUMENTS

This application is a continuation of U.S. patent application Ser. No. 15/504,782, filed Feb. 17, 2017; which is a U.S. National Stage Application of PCT/AU2015/000495, filed Aug. 19, 2015; which claims the benefit of Australian Application No. 2014215950, filed Aug. 19, 2014; the entire disclosures of said applications are hereby incorporated by reference herein.

INCORPORATION BY REFERENCE

The following publication is referred to in the present application and its contents are hereby incorporated by reference in their entirety:

International Patent Application No PCT/AU2013/000855 (WO/2014/019029) titled "FORMWORK SUPPORT ELEMENT" in the name of Form 700 Pty Ltd.

TECHNICAL FIELD

The present invention relates to concrete formwork. In a particular form the present invention relates to formwork for forming a suspended floor slab comprising a change in level in an underside thereof, such as occurs where a beam is to be moulded into the underside of the slab, and a formwork support bracket for use with such formwork.

BACKGROUND

Formwork is used in concrete construction to provide a mould onto which wet concrete can be poured for forming various elements such as suspended floor slabs and beams. In the case of floor slabs, it is common for floors of a multistorey building to be formed sequentially and for formwork to be set out on a preceding floor in order to form a subsequent higher floor.

Such formwork normally comprises a frame or scaffolding that is used to support elevated forms comprising either lost formwork or formwork that can be removed from the concrete slab once the concrete is set. Reusable formwork may comprise aluminium formwork pans which are held at the top of the scaffolding. In addition, sheets or boards may also be used at the top of the framework.

One issue arises where a change in a level in an underside of a suspended floor slab is required, such as occurs where a beam is to be moulded into the underside of the slab. Currently, where a beam is to be formed, formwork for a side of a beam mould is generally contrived from horizontal timber beams and vertical plywood sheets. Assembling a beam formwork in this way is quite time consuming, and therefore expensive in terms of labor costs.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided a formwork support bracket for use with table forms to form a suspended floor slab comprising a change in level in an underside thereof, the formwork support bracket comprising a base, a wall extending from the base, and a formwork support atop of the wall, wherein in use the base sits atop lower formwork, the formwork support supports upper formwork, and the wall provides a surface for moulding an edge extending between the upper and lower formworks.

In one form, the upper and lower formworks are vertically spaced apart.

In one form, the lower formwork forms a mould for a lower level in an underside of a suspended floor slab.

In one form, the upper formwork forms a mould for an upper level in an underside of a suspended floor slab.

In one form, the formwork support comprises an upper formwork support platform.

In one form, the formwork support comprises a beam cradle comprising a cradle wall forming a continuous surface with the wall extending from the base.

In one form, the formwork support comprises at least one locating lug for engaging with a formwork to locate the formwork with respect to the formwork support bracket.

In one form, the upper and lower formwork comprises formwork panels.

In one form, the bracket comprises a column extending from the base, where the column comprises the wall for forming the step, and wherein the formwork support platform and the beam cradle sit atop of the column.

In one form, the bracket comprises a pair of columns extending from the base and supporting the platform.

In one form, the formwork comprises panels, such as those sold under the proprietary name Airodck, or similar.

According to a second aspect, there is provided a formwork arrangement comprising a temporary support structure (falsework) for supporting each of upper and lower formworks for forming upper and lower levels in an underside of a suspended floor slab, each of the upper and lower formworks terminating at an edge, where the upper formwork edge and lower formwork edge are adjacent and vertically spaced apart, and a plurality of formwork support brackets set atop of the lower formworks and supporting a plurality of formwork panels bridging the edge of the upper formworks and the formwork support brackets.

According to a third aspect, there is provided a method for forming a suspended floor slab comprising a change in level in an underside thereof, the method comprising the steps of erecting a temporary support structure (falsework) supporting each of upper and lower formworks for forming upper and lower levels in the underside of a suspended floor slab, where each of the upper and lower formworks terminate at an edge, where the upper formwork edge and lower formwork edge are adjacent and vertically spaced apart, positioning a plurality of formwork support brackets atop of the lower formworks, and positioning a plurality of formwork panels so that these bridge the edge of the upper formworks and the formwork support brackets.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

The accompanying drawings, which are incorporated in and constitute a part of this specification, illustrate certain embodiments of the invention, and together with the description, serve to explain the principles of the invention.

Those skilled in the art will appreciate that the conception upon which this disclosure is based may readily be utilized as a basis for designing other structures, methods, and systems for carrying out the several purposes of the present invention. It is important, therefore, to recognise that the claims should be regarded as including such equivalent constructions insofar as they do not depart from the spirit and scope of the present invention.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Figure 1:
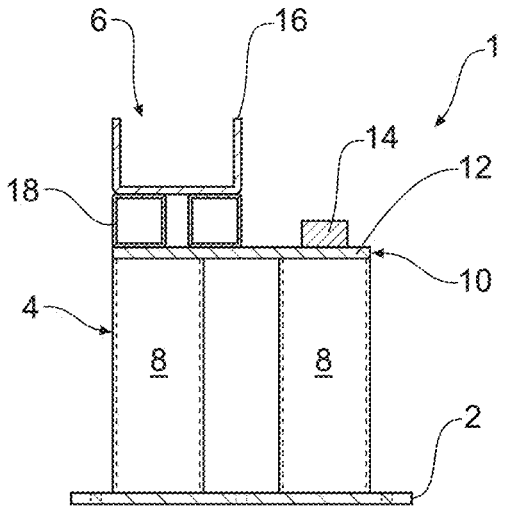
FIG. 1 is a front view of a support bracket.
Figure 2:
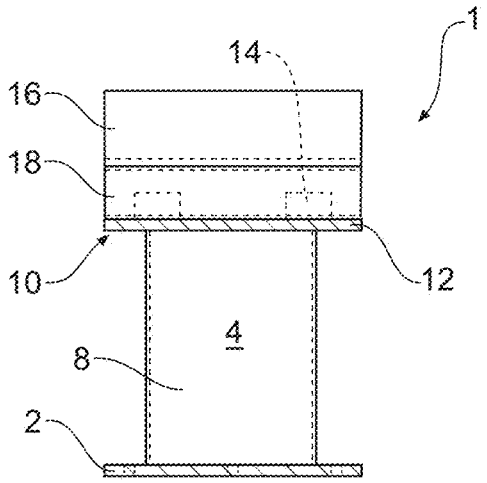
FIG. 2 is a side view of the support bracket of FIG. 1.
Figure 3:
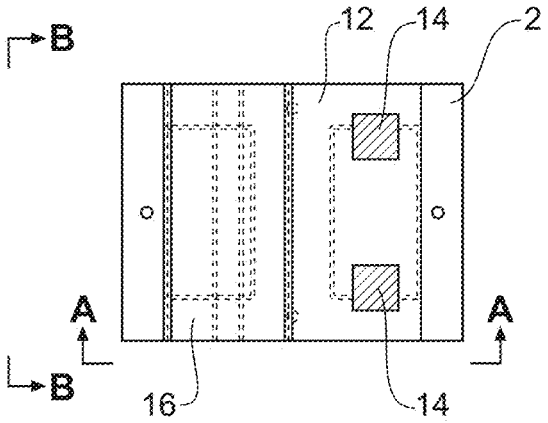
FIG. 3 is a top view of the support bracket of FIGS. 1 and 2.

Referring now to FIGS. 1 through 3, where there is shown a formwork support bracket 1, comprising a base 2, a wall 4 extending from the base 2, and a formwork support 6 atop of the wall 4.

The exemplary formwork support bracket 1 set forth in the following description is formed by metal fabrication, although it need not necessarily be manufactured in this way, or from this material. It could, for instance, be manufactured by another means, such as casting, and from another material, such as another alloy or a composite.

In this exemplary embodiment, the base 2 is a mild steel plate of rectangular shape, from which there extends a pair of columns 8 of rectangular hollow section (RHS) steel standing on end and welded to the base. One of the faces of one of these columns 8 serves as the wall 4.

The formwork support 6 sits atop of the columns 8 and comprises a formwork support platform 10 comprising a further mild steel plate 12 of rectangular shape and a pair of locating lugs 14, the purpose of which will be discussed in detail below.

The formwork support 6 further comprises a beam cradle 16 comprised of mild steel parallel flange channel (PFC) which is arranged so that one of the flanges forms a continuous surface with the wall 4 extending from the base 2.

In this exemplary embodiment, the beam cradle 16 is supported atop a pair of laid over mild steel square hollow section (SHS) tubes, which may or may not be required depending on the type of formwork to be supported by the bracket 1.

In use, the formwork support bracket 1 is used with temporary support structures (sometimes referred to as falsework) to support formwork for forming a suspended floor slab comprising a change in level in an underside thereof.

Figure 4:
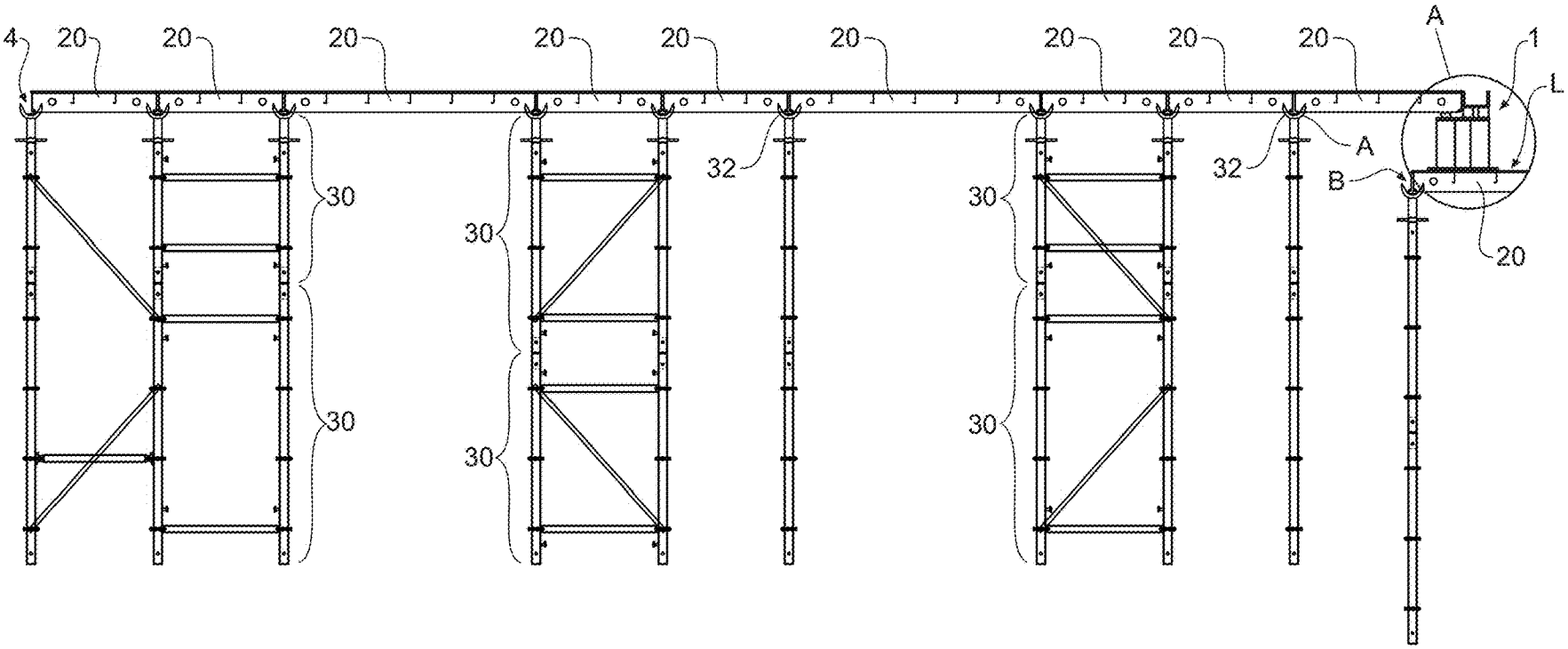
FIG. 4 is a schematic illustration of an assembly for use with table forms to form a change in level in an underside of a suspended floor slab, the assembly comprising the support bracket illustrated in FIGS. 1 through 3.
Figure 7:
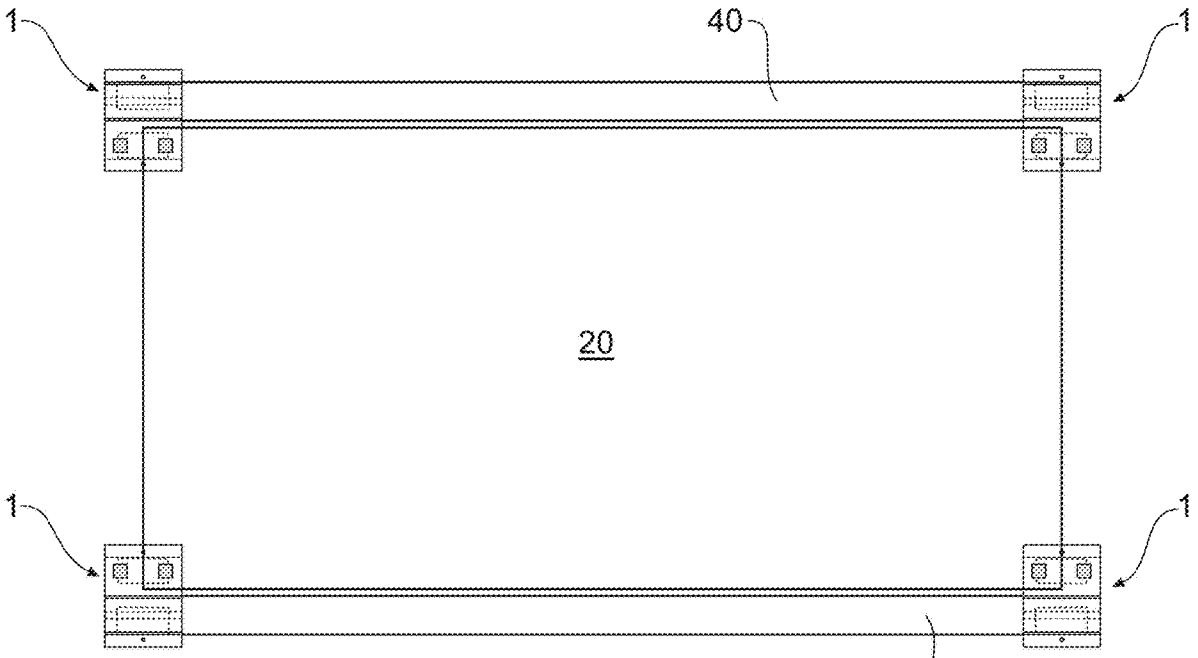
FIG. 7 is a plan view of a formwork panel supported by four support brackets.

Referring now to FIG. 4, the formwork for forming a suspended floor slab comprising a change in level in an underside thereof will comprise upper and lower formworks U and L, which are vertically spaced apart, with the lower formwork L forming a mould for a lower level in an underside of the suspended floor slab, and the upper formwork U forming a mould for an upper level in the underside of a suspended floor slab.

For the purpose of explanation, the formwork will largely, but not exclusively, comprise formwork panels of the type commonly referred to by the proprietary name "Airodek", and the temporary support structures will largely, but not exclusively, comprise scaffold structures of the type disclosed in PCT/AU2013/000855.

In use, the lower formwork L will comprise a plurality of formwork panels 20 supported so as to provide a continuous moulding surface, by a plurality of the scaffold structures 30.

Similarly, the upper formwork U will comprise a plurality of formwork panels 20 supported so as to provide a continuous moulding surface, by a plurality of the scaffold structures 30 at a level vertically spaced apart from the lower formwork panels 20.

The upper and lower formworks U and L will each terminate at an edge, where the upper formwork edge A and lower formwork edge B are adjacent, less than one formwork panel's 20 length (or width) apart, and in all likelihood substantially parallel. With the majority formwork and falsework arranged in this way, a plurality of the formwork support brackets 1 can be set atop of the lower formworks L, so that a plurality of formwork panels 20 can be positioned so as to bridge the edge A of the upper formworks U and the formwork support brackets 1.

That is to say, each bridging formwork panel 20 will be supported at each of its corners. Each of one pair of corners will be supported on a prong of a fork 32 provided by one or more of the support structures 30. Each of the other pair of corners will be supported on a locating lug 14 of a different formwork support bracket 1.

Figure 6:
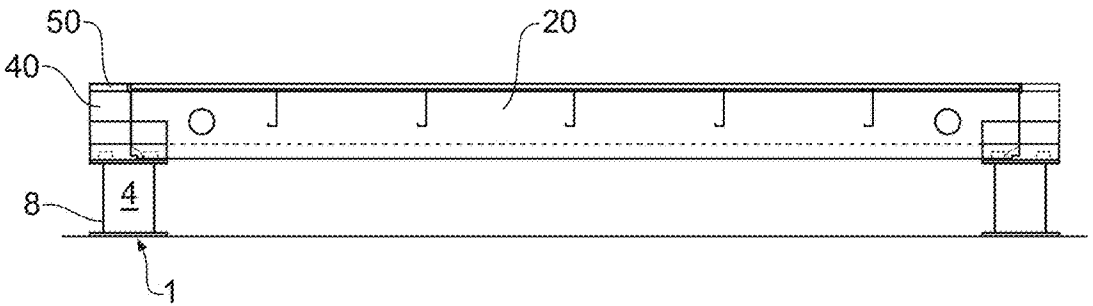
FIG. 6 is a detail end view of the step in the formwork illustrated in FIG. 5.
Figure 5:
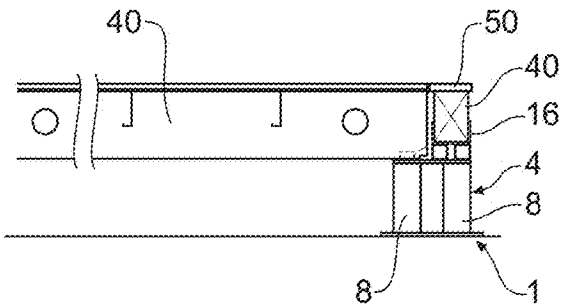
FIG. 5 is a detail front view of the step in the formwork.

With reference to FIGS. 5 and 6, it can be seen that in order to build up some formwork at the corner to the level of the formwork panel 20, a timber beam 40 is laid in the beam cradle 16, and a sheet of plywood 50 is laid atop of this so as to create a formwork surface which is a continuation of the upper formwork surface extending to form a corner with the flange of the beam cradle 16 which itself forms a continuous surface with the wall 4 extending from the base 2.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A formwork support bracket for use with a temporary support structure supporting each of upper and lower formworks to form a suspended floor slab comprising a change in level in an underside thereof, the formwork support bracket comprising:

a base plate;

at least one column extending from the base plate, wherein a face of, or one of the at least one columns serves as a wall extending from the base plate; and a formwork support atop of the at least one column comprising an upper formwork support platform in the form of a plate and a beam cradle supported by the upper support platform, comprised of a parallel flange channel and arranged so that one of the flanges forms a continuous surface with the wall extending from the base plate, the formwork support further comprising at least one locating lug extending from the formwork support platform, for engaging with the upper formwork to locate the upper formwork adjacent to the beam cradle;

wherein in use the base plate sits atop the lower formwork, the formwork support supports a portion of the upper formwork adjacent to the beam cradle, and the continuous surface formed by the wall and flange provides a formwork support surface for moulding an edge extending between the upper and lower formworks.

2. The formwork support bracket of claim 1, comprising a pair of columns extending from the base plate.

3. The formwork support bracket of claim 1, wherein the upper and lower formwork comprises formwork panels.

4. The formwork support bracket of claim 1, wherein the formwork support comprises two locating lugs extending from the formwork support platform.

* * * * *